US010208572B2

(12) United States Patent
Cook et al.

(10) Patent No.: US 10,208,572 B2
(45) Date of Patent: Feb. 19, 2019

(54) APPARATUS AND METHOD FOR PERFORATING A SUBTERRANEAN FORMATION

(71) Applicant: Halliburton Energy Services, Inc., Houston, TX (US)

(72) Inventors: Jason Cook, Joshua, TX (US); Robert Albers, Waxahachie, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 178 days.

(21) Appl. No.: 15/025,480

(22) PCT Filed: Oct. 29, 2013

(86) PCT No.: PCT/US2013/067205
§ 371 (c)(1),
(2) Date: Mar. 28, 2016

(87) PCT Pub. No.: WO2015/065328
PCT Pub. Date: May 7, 2015

(65) Prior Publication Data
US 2016/0215596 A1 Jul. 28, 2016

(51) Int. Cl.
*E21B 43/112* (2006.01)

(52) U.S. Cl.
CPC ..... *E21B 43/112* (2013.01)

(58) Field of Classification Search
CPC ..... E21B 43/11; E21B 43/112; E21B 43/114; E21B 43/11852; E21B 43/11855
USPC ..... 166/297, 298, 55.2, 55.3
See application file for complete search history.

(56) References Cited

U.S. PATENT DOCUMENTS

| | | | | | |
|---|---|---|---|---|---|
| 724,904 | A * | 4/1903 | Mack | E21B 43/112 | 166/55.3 |
| 1,543,903 | A * | 6/1925 | Cameron | E21B 43/112 | 166/55.3 |
| 2,108,172 | A * | 2/1938 | Margrave | E21B 43/112 | 166/55.3 |
| 2,638,801 | A * | 5/1953 | Klaasen | E21B 43/112 | 166/237 |

(Continued)

FOREIGN PATENT DOCUMENTS

EP 0952302 10/1999

OTHER PUBLICATIONS

International Search Report and Written Opinion of PCT Application No. PCT/US2013/067205 dated Jul. 25, 2014: pp. 1-12.

(Continued)

*Primary Examiner* — Brad Harcourt
*Assistant Examiner* — David Carroll
(74) *Attorney, Agent, or Firm* — Chamberlain Hrdlicka

(57) ABSTRACT

Method and apparatus are presented for perforating a subterranean formation so as to establish fluid communication between the formation and a wellbore by perforating a tubular with a mechanical perforator. The mechanical perforator comprises a perforator housing, a mandrel slidably positioned within the perforator housing, and at least one penetrator outwardly extendable from the perforator housing. When shifted axially the mandrel causes at least a portion of the at least one penetrator to extend outwardly from the perforator housing to perforate the tubular.

14 Claims, 6 Drawing Sheets

(56) References Cited

U.S. PATENT DOCUMENTS

| | | | | |
|---|---|---|---|---|
| 3,111,989 | A * | 11/1963 | Tamplen | E21B 43/112 166/55.3 |
| 6,755,249 | B2 | 6/2004 | Robison et al. | |
| 7,467,661 | B2 | 12/2008 | Gordon et al. | |
| 2003/0070811 | A1* | 4/2003 | Robison | E21B 43/103 166/298 |
| 2003/0075316 | A1 | 4/2003 | Marsh et al. | |
| 2007/0277980 | A1 | 12/2007 | Gordon et al. | |
| 2010/0258289 | A1 | 10/2010 | Lynde et al. | |
| 2013/0248200 | A1 | 9/2013 | June et al. | |

OTHER PUBLICATIONS

Anonymous, "Otis A Type Tubing Perforator Punch," Halliburton Hunting, Wireline Equipment Catalogue v.3.2.

* cited by examiner

APPARATUS AND METHOD FOR PERFORATING A SUBTERRANEAN FORMATION

CROSS-REFERENCE TO RELATED APPLICATIONS

None.

TECHNICAL FIELD

This disclosure relates to a downhole perforator assembly positioned at a target location in a well for perforating a subterranean formation.

BACKGROUND

In the process of establishing an oil or gas well, the well is typically provided with an arrangement for selectively establishing fluid communication between the interior of a tubular string, such as a casing, a liner, a tubing or the like and the annulus surrounding the tubular string. One method for establishing such communication is through the use of explosives, such as shaped charges, to create one or more openings through the tubular string. The shaped charges typically include a housing, a quantity of high explosive and a liner. In operation, the openings are made by detonating the high explosive which causes the liner to form a jet of particles and high pressure gas that is ejected from the shaped charge at very high velocity. The jet is able to penetrate the tubular string, thereby forming an opening.

The process of perforating through the casing dissipates a substantial portion of the energy from the explosive perforating device and the formation receives only a minor portion of the perforating energy. Further, explosives create high-energy plasma that can penetrate the wall of the adjacent casing, cement sheath outside the casing, and the surrounding formation rock to provide a flow path for formation fluids. Unfortunately, the act of creating a perforation tunnel may also create some significant debris and due to the force of the expanding plasma jet and drive some of the debris into the surrounding rock thereby plugging the newly created flow tunnel.

Moreover, as hydrocarbon producing wells are located throughout the world, it also has been found that certain jurisdictions discourage or even prohibit the use of such explosives. In these jurisdictions and in other locations where it is not desirable to use explosives, mechanical perforators have been used to establish communication between the interior of a tubular string and the surrounding annulus.

BRIEF DESCRIPTION OF THE DRAWINGS

For a more complete understanding of the features and advantages of the present disclosure, reference is now made to the detailed description of the disclosure along with the accompanying figures in which corresponding numerals in the different figures refer to corresponding parts and in which.

Figure 1:
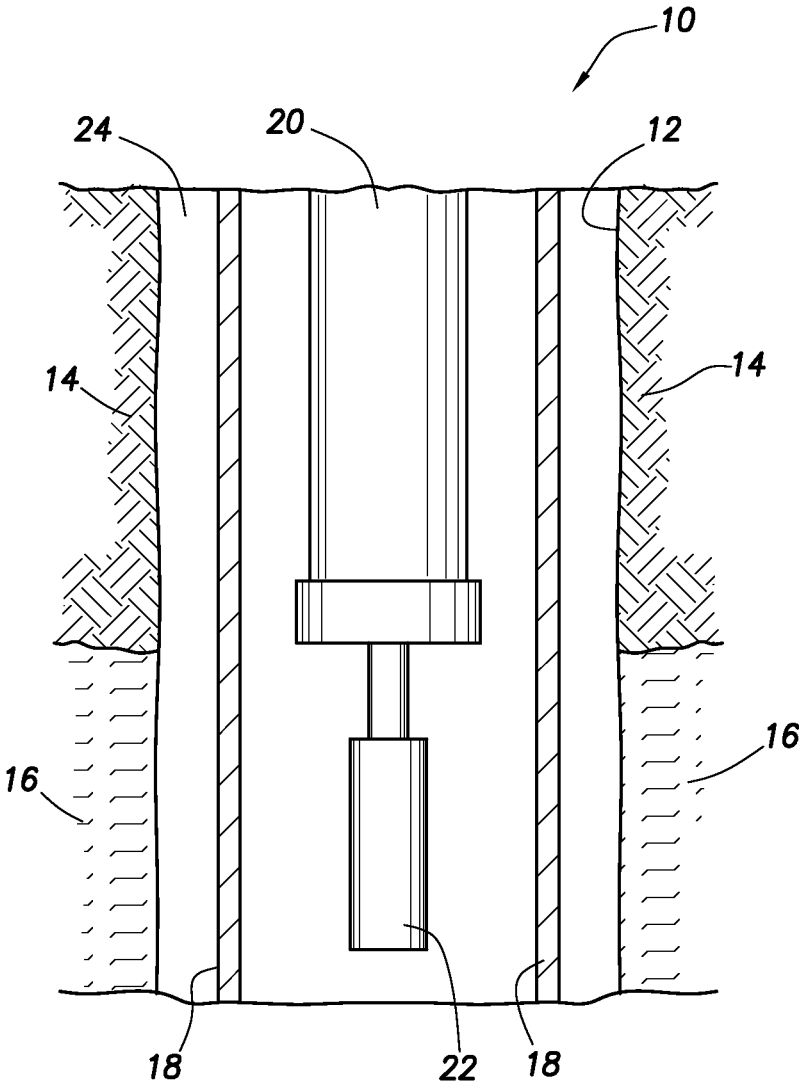
FIG. 1 is an elevational cross-sectional view of a downhole portion of a cased well.

It should be understood by those skilled in the art that the use of directional terms such as above, below, upper, lower, upward, downward and the like are used in relation to the illustrative embodiments as they are depicted in the figures. Where this is not the case and a term is being used to indicate a required orientation, the specification will make such clear. Upstream, uphole, downstream and downhole are used to indicate location or direction in relation to the surface, where upstream indicates relative position or movement towards the surface along the wellbore and downstream indicates relative position or movement further away from the surface along the wellbore, unless otherwise indicated.

Even though the methods herein are discussed in relation to a vertical well, it should be understood by those skilled in the art that the system disclosed herein is equally well-suited for use in wells having other configurations including deviated wells, inclined wells, horizontal wells, multilateral wells and the like. Accordingly, use of directional terms such as "above", "below", "upper", "lower" and the like are used for convenience. Also, even though the discussion refers to a surface well operation, it should be understood by those skilled in the art that the apparatus and methods can also be employed in an offshore operation.

DETAILED DESCRIPTION

The present disclosures are described by reference to drawings showing one or more examples of how the disclosures can be made and used. In these drawings, reference characters are used throughout the several views to indicate like or corresponding parts. In the description which follows, like or corresponding parts are marked throughout the specification and drawings with the same reference numerals, respectively. The drawings are not necessarily to scale and the proportions of certain parts have been exaggerated to better illustrate details and features of the disclosure. In the following description, the terms "upper", "upward", "lower", "below", "downhole", "longitudinally", "axially" and the like, as used herein, shall mean in relation to the bottom, or furthest extent of, the surrounding wellbore even though the wellbore or portions of it may be deviated or horizontal. Correspondingly, the "transverse" or "radial" orientation shall mean the orientation perpendicular to the longitudinal or axial orientation. In the discussion which follows, generally cylindrical well, pipe and tube components are assumed unless expressed otherwise.

Overview

FIG. 1 shows a portion of hydrocarbon well 10. Wellbore 12 extends through formation 14 having at least one producing, or hydrocarbon bearing, zone 16. To avoid communication with non-producing zones, wellbores are typically cased, such as with tubular 18 such as a casing string, a liner string, a tubing string or the like. In the illustrated wellbore 12, a work string 20 has been run in, including tool subassembly 22, which may house various well tools, including the mechanical perforator of the present disclosure. In the illustrated embodiment, tubular 18 has been previously installed within wellbore 12 such that an annular space 24 is formed between tubular 18 and wellbore 12. To allow flow from the surrounding formation and particularly the hydrocarbon bearing zone 16, a communication path such as tubular passageway or perforation 26 must be established between the interior 28 of tubular 18 and annulus 24.

Figure 2:
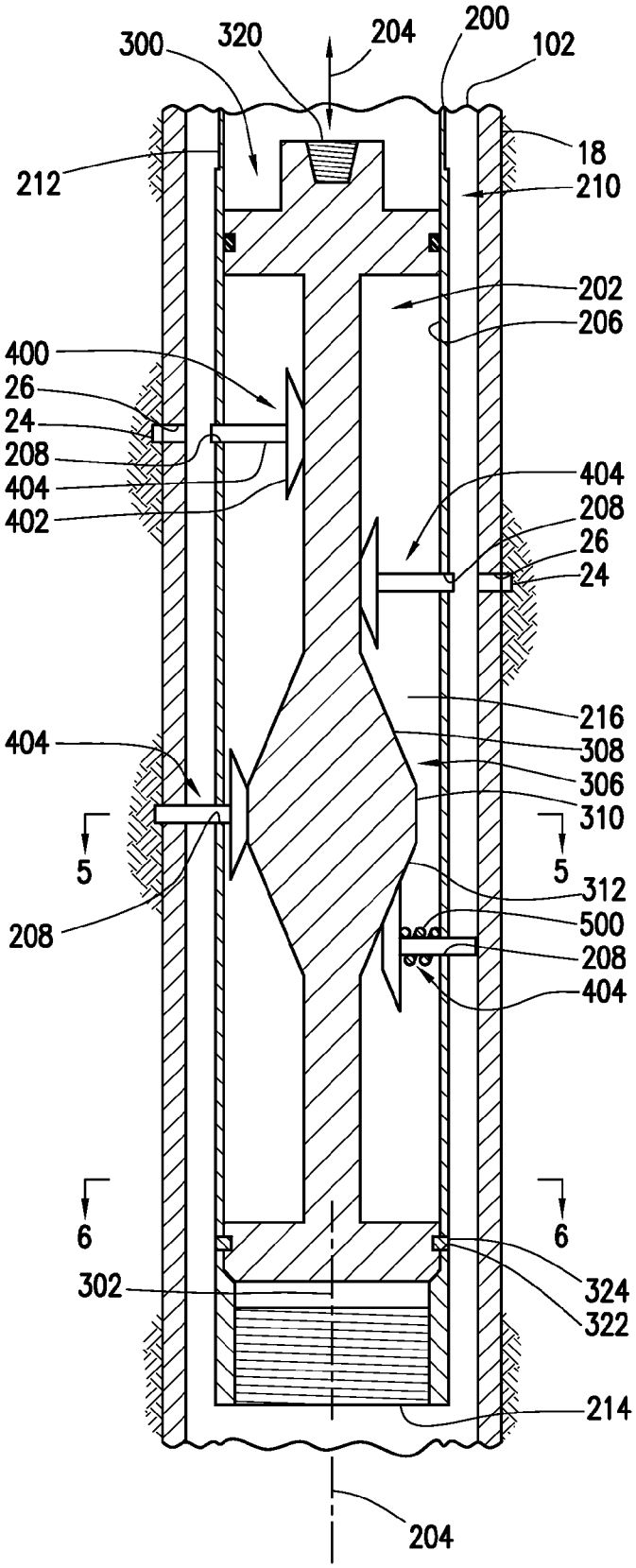
FIG. 2 is an elevational cross-sectional view of a mechanical perforator as described herein.
Figure 3:
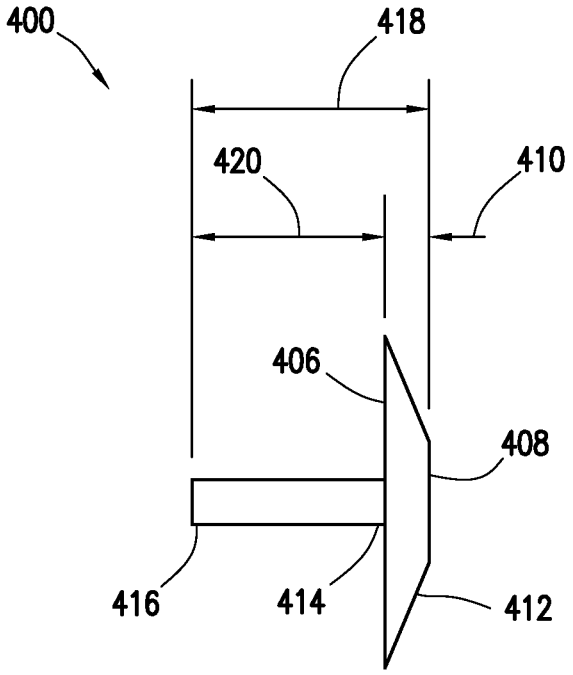
FIG. 3 is a cross-sectional view of a penetrator as described herein.
Figure 4:
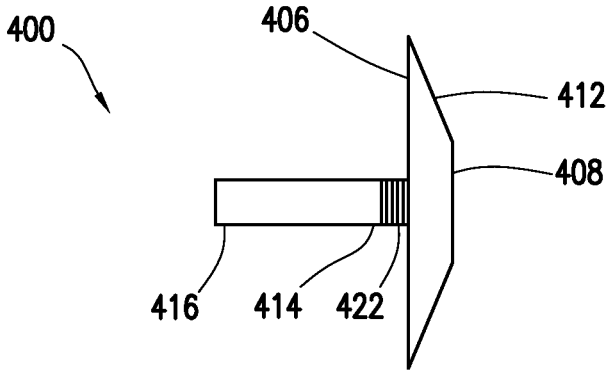
FIG. 4 is a cross-sectional view of a penetrator as described herein.
Figure 5:
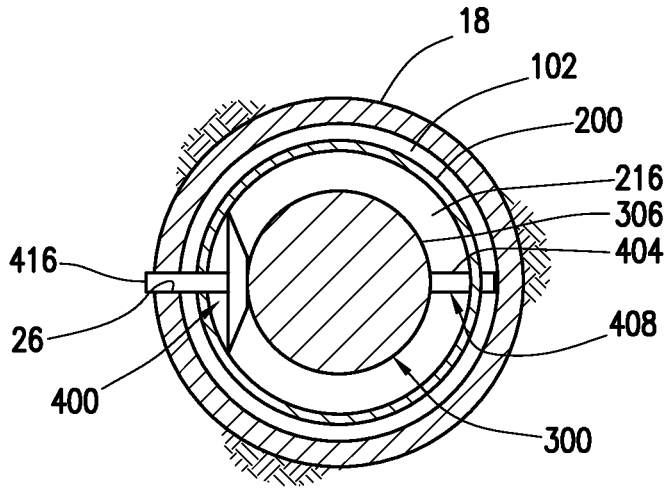
FIG. 5 is a cross-sectional view along line 5-5 of the mechanical perforator of FIG. 2.
Figure 6:
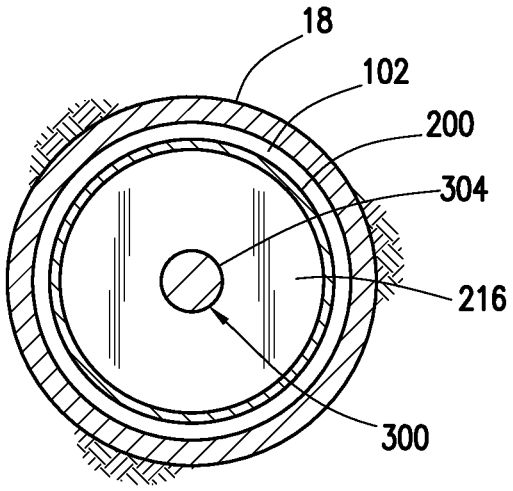
FIG. 6 is a cross-sectional view along line 6-6 of the mechanical perforator of FIG. 2.

Referring to FIG. 2, therein is depicted a downhole perforator tool of the present disclosure that is generally designated 100. Downhole perforator tool 100 is illustrated as having been lowered into a tubular 18 on a conveyance such as a wireline, a slickline, coiled tubing, jointed tubing, downhole robot or the like as explained in further detail below. Locating of the downhole perforator tool 100 within the tubular 18 forms a tool annulus 102. Downhole perforator tool comprises a perforator housing 200, a mandrel 300 slidably positioned within the perforator housing 200, and at least one penetrator 400 radially outwardly extendable from the perforator housing 200, such that axially shifting the mandrel 300 urges the penetrator 400 outwardly to perforate a tubular 18 to form tubular passageway 26.

Perforator housing 200 is generally cylindrical and has a central bore 202 having a central longitudinal axis 204 and an inner surface 206 with opening 208 formed therethrough for receiving at least a portion of penetrator 400. At upper end 210, perforator housing 200 has a radially reduced exterior portion 212 that allows for coupling with a downhole power unit or movable shaft. Perforator housing 200 has a lower connector 214 that allows downhole perforator to be coupled to other downhole tools.

Slidably and sealing disposed within perforator housing 200 is mandrel 300, which form an annular space 216. Mandrel 300 has a central axis 302 through its length, and in the illustrated embodiment the mandrel central axis 302 and the central longitudinal axis 204 are approximately coaxial and is disposed centrally within the perforator housing 200, but may be offset radially in certain applications and downhole environments.

Mandrel 300 has a main section 304 and at least one radially expanded section 306 with respect to the main section. In the illustrated embodiment, the at least one radially expanded section 306 comprises a first transition portion 308 of increasing diameter or cross section, a radially outermost portion 310 having a substantially unvarying diameter or cross section, and a second transition portion 312 that has a decreasing diameter or cross section. As the mandrel central axis 302 and the central longitudinal axis 204 of perforator housing 200 are approximately coaxial in the illustrated embodiment, annular space 216 is approximately radially symmetrical along the length of the central bore 202.

Mandrel 300 also includes an upper connector 320 that is designed to couple to a moveable shaft 30 such as connected to a downhole power unit or actuator. Mandrel 300 also has a seal groove 322 having a seal 324 located therein, which provides the sealing relationship with bore 202 of perforator housing 200.

Downhole perforator tool 100 also includes at least one penetrator 400 that is disposed between the mandrel 300 and the perforator housing 200. The penetrator 400 is radially outwardly extendable from the perforator housing such that axially shifting of the mandrel along an axis relative to the perforator housing causes at least a portion of the penetrator to extend outwardly from the perforator housing. Outward extension of the penetrator from the perforator housing perforates the tubular 18 to form a tubular passageway or perforation 26. In the illustrated embodiment, a plurality of penetrators are provided during operation of perforator tool 100 multiple tubular passageways 26 can be made with each axial movement of the mandrel 200, in a particular example a pair of penetrators may be positioned opposed one another relative to the central longitudinal axis 204 to bilaterally perforate the tubular.

In the illustrated embodiment shown in particular in FIGS. 3-6, penetrator 400 comprises a base section 402 and a punch member 404. Base section 402 operably engages mandrel 300. Base section 402 has a top or first surface 406 and a bottom or second surface 408, which are approximately parallel to the housing central axis 204 and spaced apart to define a height 410, and further having a sidewall 412. In one aspect the first and second surfaces 406, 408 are spaced apart but in another aspect are surfaces of a solid base section. In the illustrated embodiment, base section 402 is substantially circular and the first and second surfaces 406, 408 each have diameter that is substantially parallel to central axis 204, with the first surface having a larger diameter than the second surface such that sidewall 412 has an acute angle with respect to the central axis. In a preferred embodiment, at least a part of the side wall 412 is substantially parallel to at least a part of the mandrel 300. One advantage of angled sidewalls is that they act has a skid that permits engagement of the expanded portion of the mandrel while reducing friction. The base section can be of any suitable shape, with or without, angled side walls.

Punch member 404 has a first end 414 and a second end 416 and at least a portion of the punch member 404 is slidably received within the housing opening 208. The first end 414 is coupled to the base section 402 and the second end 416 extends into the opening.

The overall radial height 418 of the penetrator 400 is the height 410 of base section 402 and length 420 of punch member 404 such that when the base section engages the main section 304 of the mandrel 300, the second end 416 of the punch member 404 extends at least partially through housing opening 208 without engaging or perforating tubular 18, although the second end 416 may extend into the tool annulus 102 between the perforator housing 106 and the tubular 18, as shown in FIG. 2.

An upper limit for height 410 of the base section 402 corresponds to the distance between the mandrel 300 at its widest point, which in the illustrated embodiment is the diameter of the radially outermost portion 310, and the inner surface 206 of the perforator housing 200.

In the illustrated embodiment, the base section 402 is fixedly attached to the punch member 404 and in fact the penetrator 400 could be formed of a single piece. Alternatively, the base section 402 and the punch member 404 are joined by a connector 422, which in some embodiments is flexible to allow the punch member to move relative to the base section. A flexible connector includes a hinge or similar mechanical connection known in the in art, alone or in combination with a flexible polymer connection. Where a connector 422 is included, the overall radial height 418 of the penetrator 400 is the height 410 of base section 402, length 420 of punch member 404, and length 424 of the connector.

To retract the penetrator 400 to its rest position, a retaining assembly, device, or devices 500 may be used. FIG. 2 illustrates an exemplary retaining assembly for a single punch assembly. In one embodiment, the retaining assembly comprises a resilient member such as a spring. In another embodiment, the resilient member may be disposed between the inner surface 206 of the perforator housing 200 and the top 406 of the base section 402 of the penetrator 400, and could for instance, include a spring that is disposed around the punch member 404 between the inner surface 402 of the perforator housing 200 and the top 406 of the base section.

Figure 7:
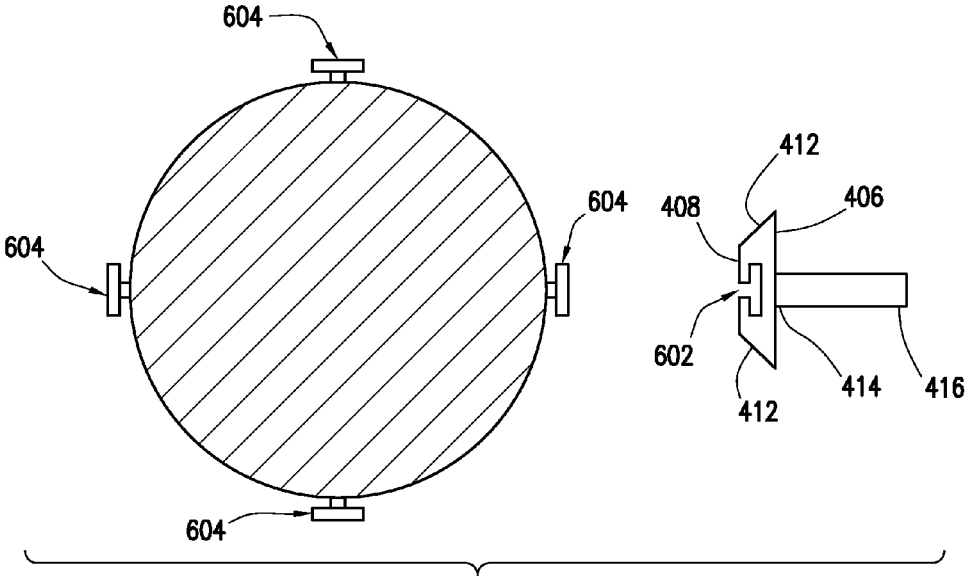
FIG. 7 is a cross-sectional view of a retainer assembly as described herein.
Figure 8:
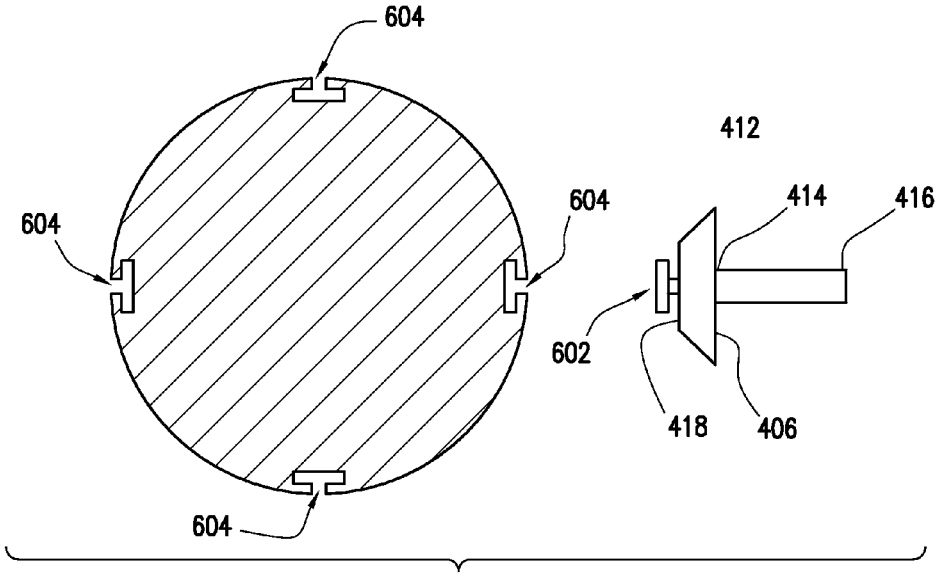
FIG. 8 is a cross-sectional view of another retainer assembly as described herein.
Figure 9:
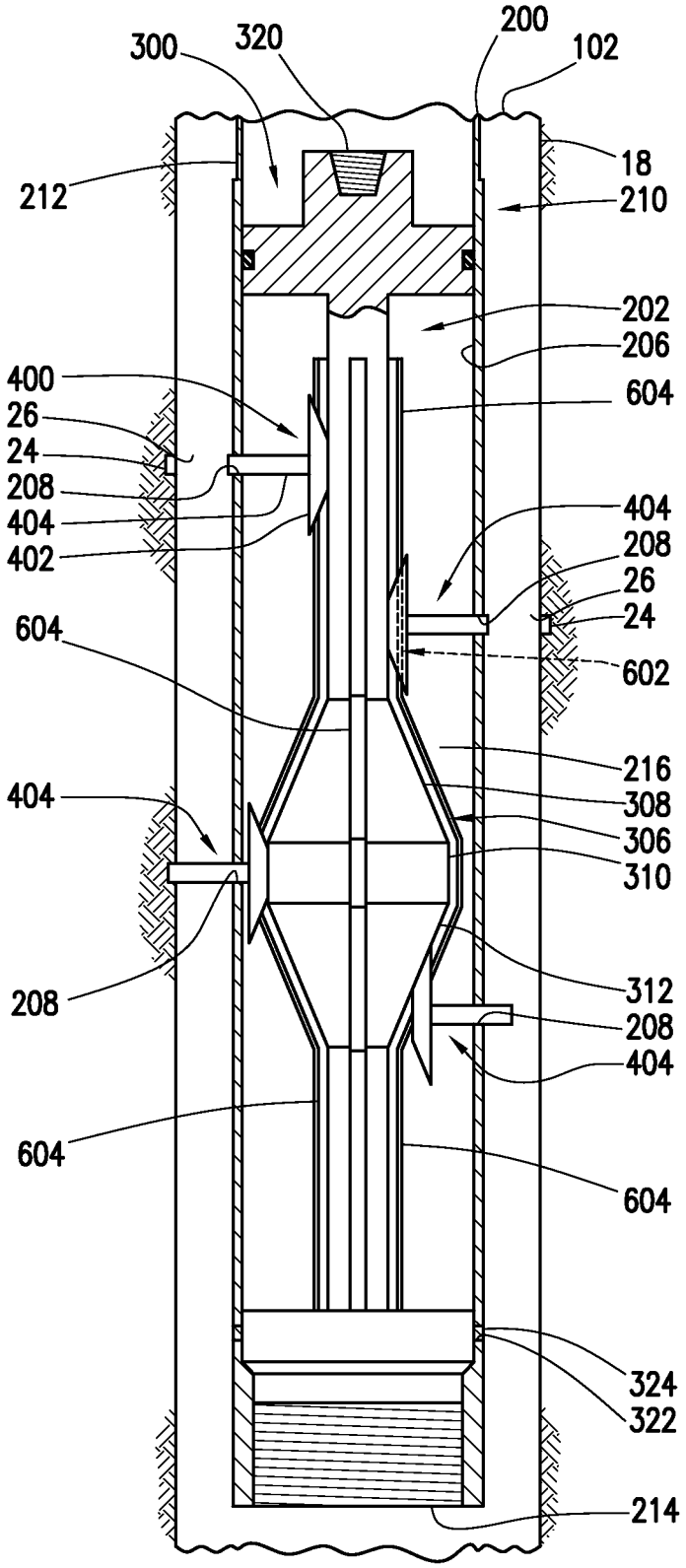
FIG. 9 is an elevational cross-sectional view of a mechanical perforator described herein showing in part the retainer assembly of FIG. 7.

FIGS. 7-9 illustrate a retraction assembly 600 for coupling mandrel 300 and penetrator 400. The penetrator and mandrel have corresponding mating features that hold the mandrel 300 and penetrator 400 in close proximity and sufficiently retract the penetrator 400 after the radially expanded portion 306 passes to withdraw the penetrator out of the tubular passageway 26. The retraction assembly 600 comprises first and second components in a mating relationship where the mandrel comprises a first component and the perforator comprises the second component. As shown in FIGS. 7 and 9, the penetrator base section 402 comprises a recess 602 that slidably engages an axially extending raised portion 604 along the mandrel's outer surface. As shown, the raised portion and the recess are T-shaped. Conversely, as shown in FIG. 8, the mandrel could include an axially extending recess and the bottom surface of the base section could include a raised portion that slidably engages the recess. Other retaining assemblies that retract the penetrator to its resting position are also contemplated.

In operation, a force is placed on mandrel 300 which shifts it axially relative to perforator housing 200, which urges penetrator 400 to extend radially outwardly from perforator housing 200 as base section 402 slides along the expansion section 312 of mandrel 300. In the illustrated embodiment, the radially outermost portion 310 is adjacent to the base section 402, punch member 404 is in its fully radially extended position. Continued axial shifting of mandrel 300 relative to perforator housing 200 retracts penetrator 404 as base section 402 slides down first or second transition zone 314, 318. Further axial movement of mandrel 200 leads to retraction of penetrator 404 inwardly towards the perforator housing 200, thereby allowing the circulation of fluids between the interior 28 of tubular 18 and annulus 24. In this manner, downhole perforator 100 is able to create an opening through the sidewall of the tubular in which downhole perforator 100 is located. After passageway 26 has been formed, downhole perforator tool 100 can be retrieved to the surface.

A method of maintaining the rotational position of the tool during operation is preferably employed to prevent damage to punches and tool parts. Restrictions of tubing size and required perforation depth may require all of the punches in the tool be of the same phasing (in the same orientation). In this case, an indexing feature can be provided to regulate and limit rotation of the punches to a new orientation to create additional perforations. The additional orientations can be effected by rotation of the tool string, the tool relative to the tool string, the mandrel and punches relative to the housing, etc. Indexing mechanisms, such as mating profiles, J-slots, etc., can be used and are known in the art.

Penetrators and passageways can be provided at nearly any location in the housing for perforating the tubular. In one preferred embodiment, the penetrators and passageways are oriented at approximately every 60 degrees around the circumference of the housing and may be staggered axially. In another embodiment, it may preferable to stagger the plurality of penetrators so that they are aligned axially, and, if desired, the tool can be rotated for sequential or repeated operation to create perforations at selected orientations in the surrounding tubular. Of course, downhole perforator 100 may be raised a desired distance along the production zone 16 to provide perforations along this length for making additional perforations, if desired.

In general operation, the perforator tool is placed in the wellbore by running on tubing to the desired location. In one aspect, a moveable shaft is connected to the mandrel and when the shaft is activated it moves downward to axially shift the mandrel and urge the penetrators outwardly with respect to the central axis, as described above. The mandrel may be returned to its original position by applied annulus pressure, by wireline, or by other methods known in the art. To ensure the tool does not move during operation, an appropriate positioning device may be employed, such as slips integrated into the assembly or by latching into a packer or similar anchor. If slips are utilized, they may be activated by the same hydraulic pressure. In another aspect, instead of hydraulic pressure, the moveable shaft may be displaced by mechanical force, such as by coiled rod, coiled tubing or wireline and the like to apply force to the mandrel to urge each punch radially to perforate the tubular.

In another mode of operation, the perforator housing can be run to a desired location and set locked with a landing nipple with standard wireline methods. The running tool may be retrieved and the mandrel run on a wireline and axially shifted by jarring such as with a mechanical jar. The process may be repeated as needed. In an alternative embodiment, the mandrel may be installed below punch housing prior to running and the top of the mandrel may be threaded to the bottom of the running tool. When the running tool is retrieved, the mandrel is axially shifted and the penetrators extend radially to perforate the tubular. Optionally, the expander may be equipped with a fishneck and the punching performed on a separate wireline trip.

While this disclosure has been described with reference to illustrative embodiments, this description is not intended to be construed in a limiting sense. Various modifications and combinations of the illustrative embodiments as well as other embodiments of the disclosure will be apparent to persons skilled in the art upon reference to the description. It is, therefore, intended that the appended claims encompass any such modifications or embodiments.

It is claimed:

1. A downhole perforator tool, comprising:

a perforator housing having a central longitudinal axis and at least one opening, a mandrel slidably positioned within the perforator housing forming an annular space, wherein the mandrel includes a radially expanded portion, and at least one penetrator slidably attached to the mandrel such that the mandrel is capable of shifting along an axis parallel to the central longitudinal axis of the perforator housing, the at least one penetrator comprising a base, a punch member, and a connector that flexibly connects the base and the punch member, and radially outwardly extendable from the perforator housing through the at least one opening, wherein axially shifting the mandrel along the axis parallel to the central longitudinal axis of the perforator housing in a first direction causes at least a portion of the at least one penetrator to extend outwardly from the perforator housing and continuing to axially shift the mandrel in the first direction causes the at least one penetrator to retract into the perforator housing.

2. The downhole perforator tool of claim 1, wherein the radially expanded portion urges the at least one penetrator outwardly relative to the perforator housing when the mandrel is axially shifted relative the perforator housing.

3. The downhole perforator tool of claim 1, wherein the mandrel is centrally positioned within the perforator housing.

4. The downhole perforator tool of claim 1, further comprising a plurality of penetrators and a plurality of openings, each penetrator extending through an opening.

5. The downhole perforator tool of claim 4, wherein a pair of penetrators are opposedly positioned relative to the central longitudinal axis.

6. The downhole perforator tool of claim 1, wherein the base assembly has a side wall acutely angled with respect to the longitudinal axis of the housing.

7. The downhole perforator tool of claim 6, wherein at least a part of the side wall is parallel to at least a part of the mandrel.

8. The downhole perforator tool of claim 1, wherein the at least one radially expanded section comprises a radially outermost portion having a diameter greater than the diameter of the mandrel.

9. The downhole perforator tool of claim 8, wherein the at least one radially expanded section further comprises a first and second transition portions, the diameter of the first portion gradually increasing to the radially outermost portion and the diameter of the second portion decreasing from the radially outermost portion.

10. A method for perforating a tubular disposed within a wellbore comprising:

providing in the wellbore a downhole perforator tool having a perforator housing, a mandrel slidably positioned within the perforator housing, and at least one penetrator slidably attached to the mandrel such that the mandrel is capable of shifting along an axis parallel to the central longitudinal axis of the perforator housing, the at least one penetrator radially outwardly extendable from the perforator housing;

axially shifting the mandrel in a first direction along the axis parallel to the central longitudinal axis of the perforator housing causing extension of at least a portion of at least one penetrator outwardly from the perforator housing;

perforating the tubular with the at least one penetrator comprising a base, a punch member, and a connector that flexibly connects the base and the punch member; and axially shifting the mandrel further in the first direction to retract the at least one penetrator into the perforator housing.

11. The method as recited in claim 10, wherein the mandrel includes an expanded portion that urges the at least one penetrator outwardly relative to the perforator housing when the mandrel is axially shifted relative the perforator housing.

12. The method as recited in claim 10, wherein axially shifting the mandrel along an axis relative to the perforator housing causes at least a portion of the at least one penetrator to retract inwardly relative to the perforator housing.

13. The method as recited in claim 11, wherein the downhole perforator tool comprises a plurality of penetrators urged outwardly by the expanded portion of the mandrel axially shifted relative the perforator housing.

14. The method as recited in claim 13, wherein the expanded portion of the mandrel urges outwardly a plurality of penetrators to create a plurality of perforations in the tubular when axially shifted relative the perforator housing during one movement.

* * * * *